US005749752A

United States Patent [19]

Kashiyama et al.

[11] Patent Number: 5,749,752

[45] Date of Patent: May 12, 1998

[54] ELECTRICAL CONNECTOR

[75] Inventors: Motohisa Kashiyama; Masanori Tsuji, both of Shizuoka, Japan

[73] Assignee: Yazaki Corporation, Tokyo, Japan

[21] Appl. No.: 670,982

[22] Filed: Jun. 28, 1996

[30] Foreign Application Priority Data

Jun. 30, 1995 [JP] Japan ..... 7-166107

[51] Int. Cl.[6] ..... H01R 13/42

[52] U.S. Cl. ..... 439/733.1; 439/744; 439/885

[58] Field of Search ..... 439/733.1, 744, 439/595, 885

[56] References Cited

U.S. PATENT DOCUMENTS

| | | | |
|---|---|---|---|
| 3,810,072 | 5/1974 | Moore | 439/733.1 |
| 4,029,385 | 6/1977 | Mysiak et al. | 439/595 |
| 4,668,042 | 5/1987 | Wildblood et al. | 439/733.1 |
| 5,342,219 | 8/1994 | Onodera et al. | 439/595 |
| 5,380,220 | 1/1995 | Okabe | 439/595 |

FOREIGN PATENT DOCUMENTS 3-66156 6/1991 Japan .

6-203888 7/1994 Japan .

*Primary Examiner*—Gary F. Paumen

*Attorney, Agent, or Firm*—Sughrue, Mion, Zinn, Macpeak and Seas

[57] ABSTRACT

A connector in which the longitudinal displacement of connection terminals is positively prevented even if electric wires are pulled rearwardly by an external force, so that the fitting property of the connector to a partner connector can be improved. In the connector according to the present invention, a plurality of solderless terminals (1) are chained to a carrier having feed holes (11), with each of the terminals having an electric-wire solderless contact portion (5) provided with a slot (4) for solderlessly connecting an electric wire. The terminals are severed from the carrier in such a manner that portions of feed holes (11) of the carrier remain in the rear end portions of the solderless terminals (1). Additionally, fitting portions (14) to be fitted into the feed holes (11) are formed on the bottom walls of a terminal holder (2) in which the terminals are received. Since the feed holes (11) are provided in the rear end portions of the solderless terminals (1), the strength of the solderless terminals (1) is not reduced. Furthermore, since the fitting portions (14) are provided so as to project from the bottom walls (12) of the terminal holder (2), the strength of the bottom walls (12) is likewise not reduced.

8 Claims, 4 Drawing Sheets

ELECTRICAL CONNECTOR

BACKGROUND OF THE INVENTION

1. Field of the Invention

The present invention relates to the structure of a connector, and particularly to a connector which is designed so that the electric wires connected to connection terminals received in the connector are prevented from being pulled out by an external force. Additionally, the present invention relates to a connector which is relatively easy to manufacture.

2. Related Art

Various connectors have been designed where the connection terminals, connected to end portions of electric wires respectively, are housed in a terminal holder. For example, JP-U-3-66156 discloses a solderless connector of this type.

FIG. 6 is a perspective view of a plurality of conventional solderless terminals connected to a carrier, and FIG. 7 is an exploded perspective view showing a main part of a conventional solderless connector. As shown in FIG. 7, the solderless connector is designed so that a terminal holder 53 is engaged with a solderless terminal 52 and then fitted into a connector housing (not shown).

The solderless terminal 52 is formed by bending a flat metal plate with a substrate 54 as its base. That is, the metal plate is bent at the center of the substrate 54 in the shape of an inverted U to form an electric-wire solderless contact portion 56 which has a slot 55 for cutting a coating portion of an electric wire. Further, a box-like contact piece fitting portion 58 is provided in the front of the substrate 54. Located within the fitting portion is a contact piece 57 for frictionally retaining a mating terminal. Further, an electric wire crimping portion 59 for retaining an electric wire is provided in the rear portion of the substrate 54.

A pair of first lock projections 60 project downwardly from the substrate 54 in the front of the electric-wire solderless contact portion 56 so as to project from the bottom surface of the substrate. Similarly, a second lock projection 61 projects from the bottom surface of the substrate 54 in the rear of the electric-wire solderless contact portion 56.

As shown in FIG. 6, to improve the production efficiency, a plurality of solderless terminals 52 connected to a carrier 62 are fed to a predetermined position on the terminal holder 53 by means of feed holes 63. Once positioned, the terminals are severed from the carrier 62.

The terminal holder 53 shown in FIG. 7 is constituted by a plurality of terminal housing portions defined by partition walls 64 and a bottom wall 65. Three fitting/lock grooves 67, 68 and 69 are provided in the bottom wall 65. When the solderless terminals 52 are mounted on the bottom wall 65 of the terminal holder 53, respective end walls 70, 71 and 72 of the fitting/lock grooves 67, 68 and 69 abut against the first and second lock projections 60 and 61 to thereby prevent the electric wires from being displaced in the direction of the length of the solderless terminals 52 and prevent the electric-wire solderless contact portions 56 from being deformed.

The procedure of attaching the solderless terminals 52 to the terminal holder 53 is as follows. After the solderless terminals 52 are fed to the terminal holder 53 by means of the carrier 62 and the associated feed holes 63, the solderless terminals 52 are severed from the carrier 62 and mounted on the bottom wall 65. In each of the solderless terminals, the respective front ends of the first lock projections 60 abut against the end walls 70 and 71 of the fitting/lock grooves 67 and 68 formed in the bottom wall 65. On the other hand, the rear end of the second lock projection 61 abuts against the end wall 72 of the fitting/lock groove 69.

When electric wires (not shown) are then pressed into slots in the contact portions of the terminals from above, coating portions of the electric wires are severed by cutting edges which define the slots 55 and the core portions of the electric wires come into contact with the edges so that the electric wires are electrically connected to the solderless terminals 52, respectively. Further, the electric wires are crimped by the electric wire crimping portions 59 respectively so as to be fixed.

When thick electric wires are pressed into the electric-wire solderless contact portions 56 respectively, the width of each of the slots 55 tends to be increased. Additionally, the inverted-U-shaped electric-wire solderless contact portions 56 tend to be expanded longitudinally. However, the enlargement of the slots 55 is prevented by the partition walls 64. Further, the expansion of the electric-wire solderless contact portions 56 is prevented as a result of the front ends of the first lock projections 60 abutting against the end walls 70 and 71 and the rear ends of the second lock projection 61 abutting against the end wall 72.

Further, the second lock projection 61 and the end wall 72 prevent the solderless terminals from being pulled out by an external force when the electric wires are pulled rearwardly.

In the conventional solderless connector, however, if the electric wires are pulled backward by a high external force, it has been found that the strength of the second lock projection and the mating end wall 72 is not sufficient to prevent the terminal from being removed from the terminal holder 53. As a result, the displacement of the solderless terminals 52 causes a short-circuiting problem to thereby lower the reliability of the solderless connector.

Further, if the second lock projection 61 and the end wall 72 are designed to be larger in an effort to increase their strength, the strength of the substrate 54 is lowered as is the strength of the bottom wall 65. As a result, the overall reliability of the terminal is lowered.

Further, if the thickness of the substrate 54 is increased to strengthen the second lock projection 61, a large force is required for attaching/detaching the connector to a mating connector because the thickness of the contact piece 57 is correspondingly increased.

Based on the foregoing, an object of the present invention is to provide a connector in which electric wires are surely prevented from being axially displaced to thereby attain an improvement in the fitting of the connector to a partner connector even in the case where the electric wires are pulled backward by a strong external force.

SUMMARY OF THE INVENTION

In order to achieve the foregoing object, according to an aspect of the present invention, a connector includes a terminal holder in which connection terminals connected to end portions of electric wires are housed. The connection terminals are held together by a carrier so as to be in parallel with each other. The terminals are severed from the carrier so that portions of feed holes of the carrier are remain in the rear end portions of the connection terminals respectively and fitting portions are formed in bottom walls of the terminal holder so as to be fitted into the feed holes. As a result, the terminals are positively retained in the terminal holder.

According to another aspect of the invention, ledges are formed in the rear ends of the bottom walls of the terminal holder so as to abut against the rear end surfaces of the connection terminals to further retain the terminals.

According to yet another aspect of the invention, it is preferable that each of the fitting portions is divided into two portions with a longitudinal gap therebetween. The two fitting portions each have a guide slope and lock projections for retaining the terminal in the terminal holder.

In the thus configured solderless connector according to the present invention, a plurality of connection terminals arranged in parallel with each other are severed from a carrier to which the connection terminals are secured and held such that feed holes of the carrier remain in the rear end portions of the connection terminals. Additionally, fitting portions are formed on the bottom wall of the terminal holder so as to be fitted into the feed holes to assist in retaining the terminals to the terminal holder.

Accordingly, after the connection terminals are fed onto the terminal holder by means of the carrier having the feed holes, the connection terminals are severed from the carrier so that the feed holes remain in the rear end portions of the connection terminals. The feed holes are fitted to the fitting portions provided on the bottom walls of the terminal holder. Accordingly, the holding force of the connection terminals in the terminal holder is increased while portions of the carrier conventionally aborted can be reduced, so that the productivity can be improved.

Furthermore, because the feed holes are provided in the rear end portions of the connection terminals, the strength of the connection terminals is not reduced. Furthermore, since the fitting portions are provided so as to project from the bottom walls of the terminal holder, the strength of the bottom walls is not reduced. Accordingly, even if electric wires are pulled in the rearward direction, the connection terminals are prevented from being displaced longitudinally. Consequently, the reliability of the connector is improved.

Furthermore, because ledges are formed on the rear ends of bottom walls of the terminal holder so as to abut against the rear end faces of the connection terminals, the longitudinal displacement of the connection terminals can be prevented surely. Consequently, the reliability of the connector is greatly improved.

Finally, since each of the fitting portions is divided into two by a gap in the longitudinal direction of the solderless terminals so that guide slopes and lock surfaces each facing outside are formed on the upper portion of the fitting portion, the rear portions of the connection terminals are positively retained even in the case where the substrate of each of the connection terminals is thin. Accordingly, not only the workability can be improved but also the displacement of the connection terminals can be further prevented. Consequently, the reliability of the connector can be improved more greatly.

DETAILED DESCRIPTION OF THE PREFERRED EMBODIMENTS

Figure 1:
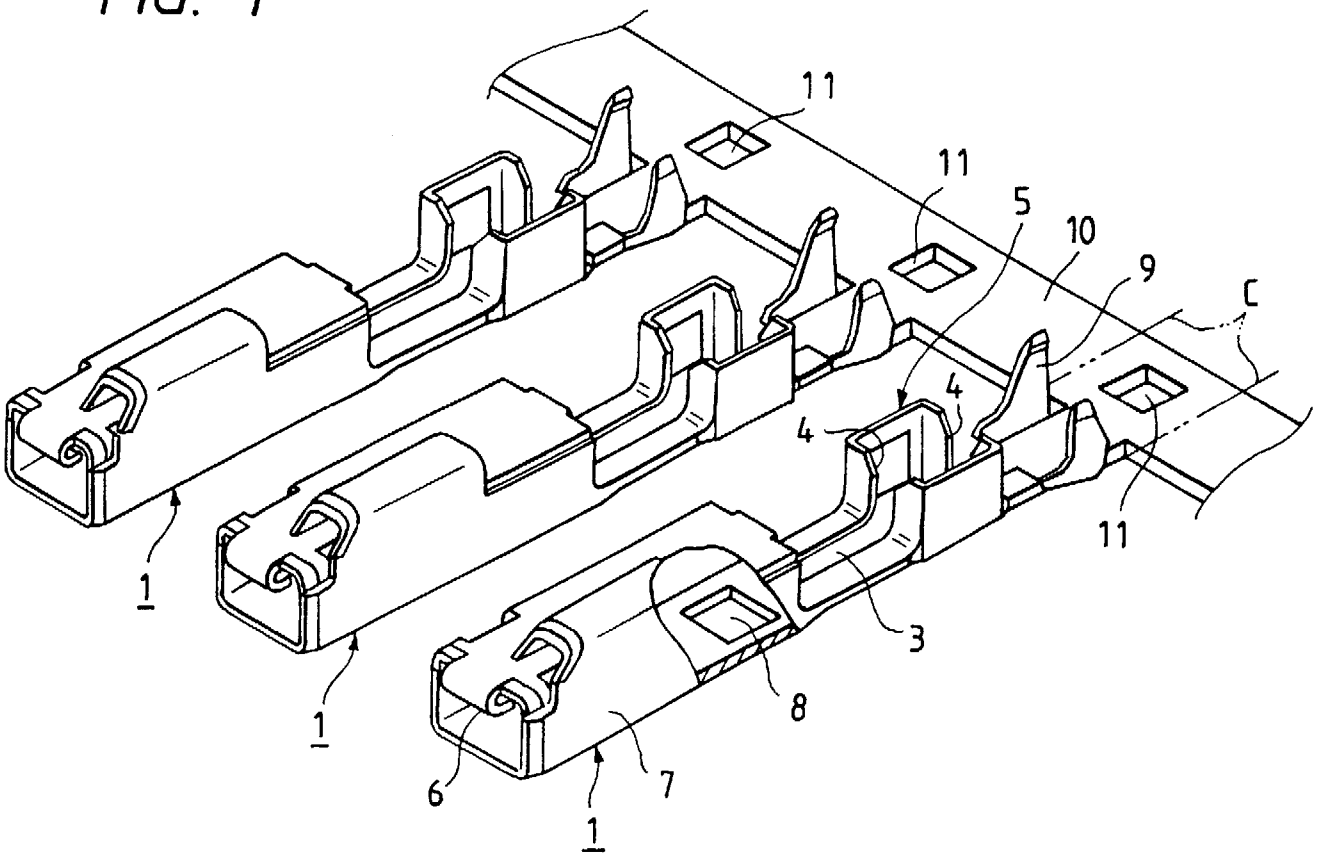
FIG. 1 is a perspective view of chained solderless terminals according to a first embodiment of the present invention.
Figure 2:
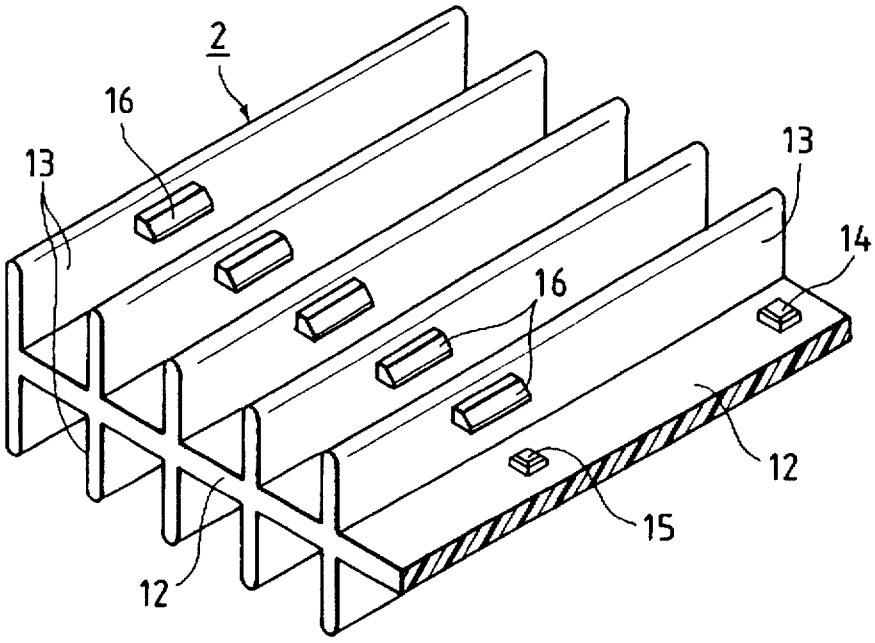
FIG. 2 is a perspective view of a terminal holder used in the above embodiment.
Figure 4:
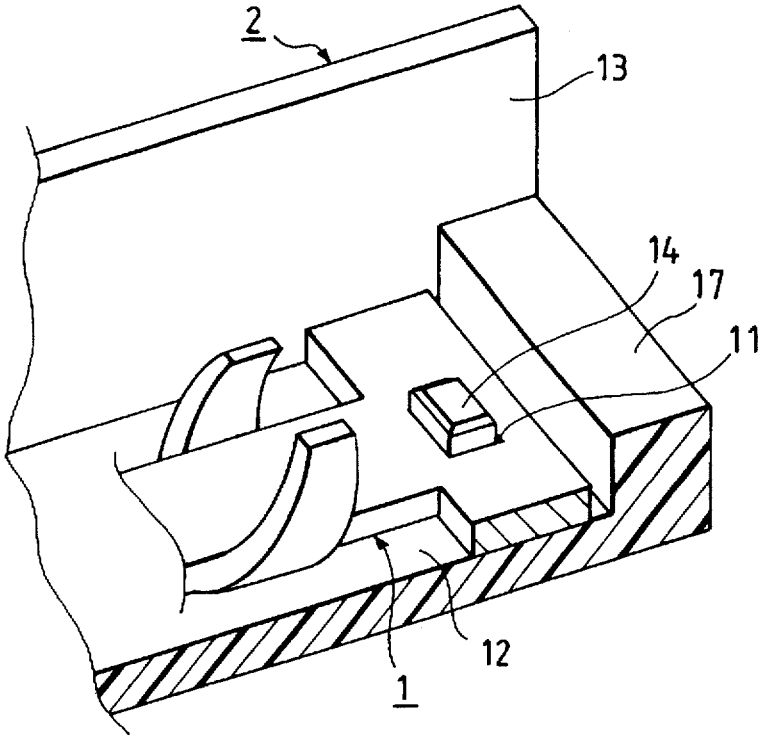
FIG. 4 is a partial exploded perspective view showing a ledge provided in the rear end portion of the terminal holder, according to another embodiment of the present invention.
Figure 5:
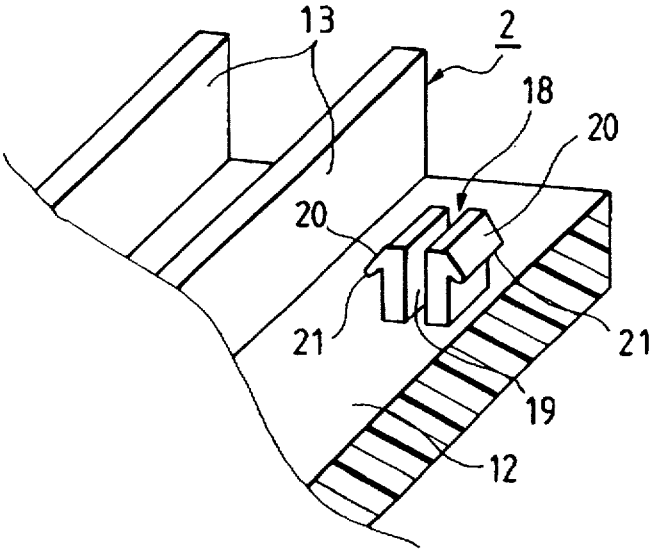
FIG. 5 is a partial exploded perspective view showing a fitting portion having lock surfaces provided on the bottom wall of the terminal holder, according to yet another embodiment of the invention.
Figure 6:
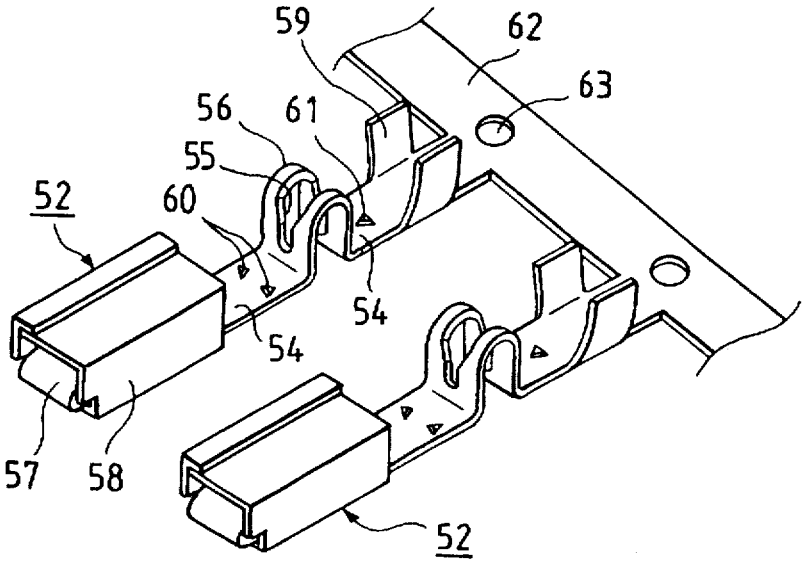
FIG. 6 PRIOR ART
FIG. 6 is a perspective view of a plurality of conventional solderless terminals which are connected to a carrier.
Figure 7:
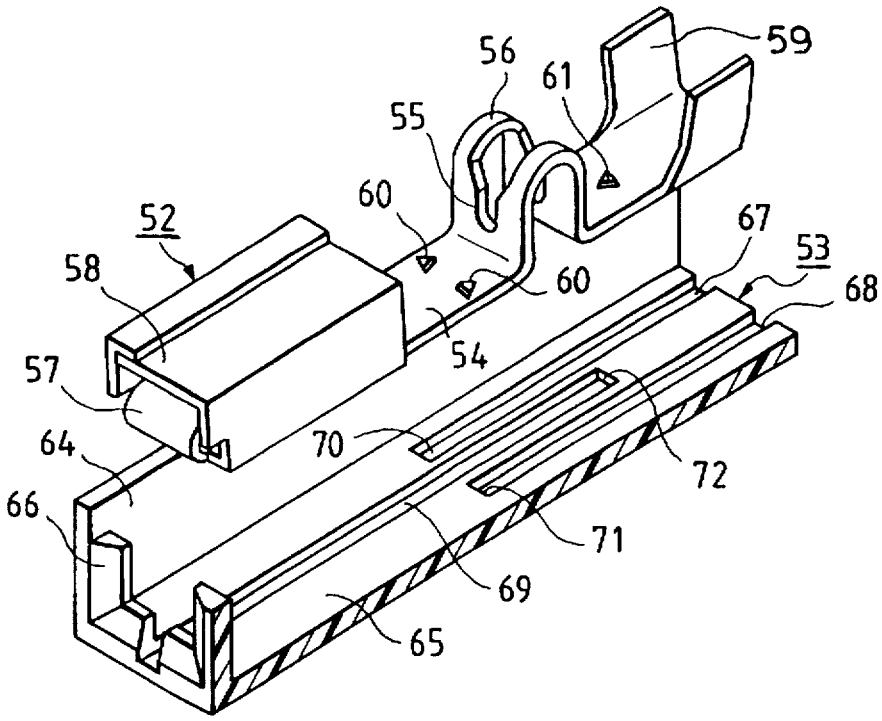
FIG. 7 PRIOR ART
FIG. 7 is an exploded perspective view showing a main portion of a conventional solderless connector.

A solderless connector as an embodiment of the present invention will be described below in detail with reference to FIGS. 1 through 5. FIG. 1 is a perspective view of a plurality of solderless terminals connected to a carrier, FIG. 2 is a perspective view of a terminal holder for housing the solderless terminals, FIG. 3 is a perspective view of solderless terminals housed in the terminal holder depicted in FIG. 2, FIG. 4 is a partial perspective view of a ledge provided in the rear end portion of the terminal holder, and FIG. 5 is a partial perspective view of a fitting portion having lock surfaces and being provided on the bottom wall of the terminal holder according to the present invention.

Figure 3:
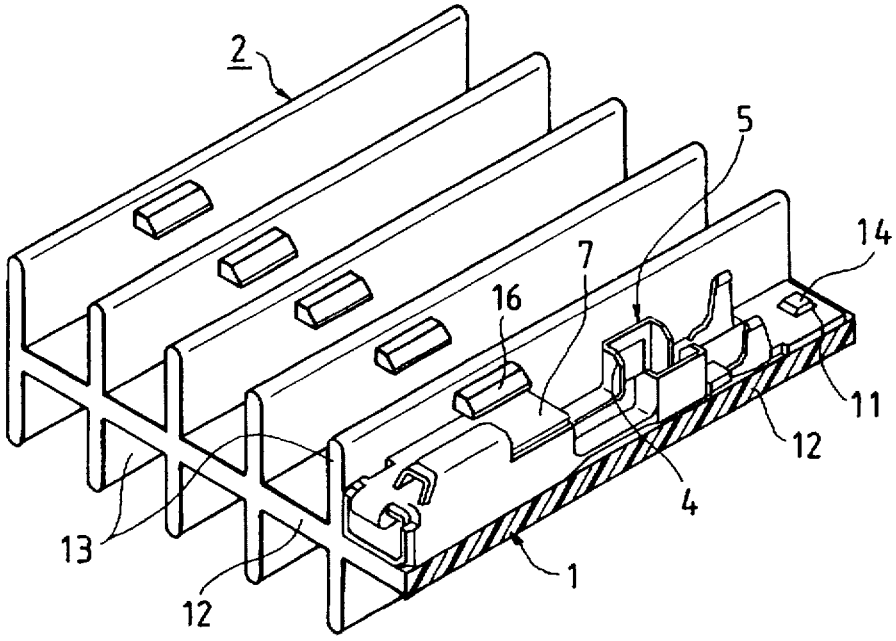
FIG. 3 is a perspective view showing the state in which solderless terminals are housed in the terminal holder depicted in FIG. 2.

FIG. 3 shows a terminal holder 2 in which female solderless terminals 1 are housed. The terminal holder is designed to be fitted into a connector housing (not shown) to constitute a solderless connector.

As shown in FIG. 1, each of the solderless terminals 1 is formed by bending a flat metal plate with a substrate 3 as its base. In more detail, the substrate 3 is bent at its center portion to form a box-like electric-wire solderless contact portion 5 having a slot 4 for cutting an insulation portion of an electric wire. Further, a box-like contact piece fitting portion 7 is provided in the front end portion of the substrate 3. A contact piece 6 extends inside the fitting portion 7 for electrically contacting a mating connector. Further, a lock hole 8 is formed in the substrate 3 inside the contact piece fitting portion 7, and an electric wire crimping portion 9 for fixing the electric wire is provided in the rear end portion of the substrate 3.

After the solderless terminals 1, which are connected to a carrier 10 so as to be parallel with each other, are fed into a predetermined terminal holder 2 by means of feed holes 11, the solderless terminals 1 are severed, as separate solderless terminals 1, from the carrier 10. The solderless terminals 1 are severed at the cutting portions C so that the portions of the feed holes 11 of the carrier 10 remain in the rear end portions of the solderless terminals 1, respectively.

As shown in FIGS. 2 and 3, the terminal holder 2 is partitioned into a plurality of terminal housing portions by bottom walls 12 and partition walls 13. Further, fitting portions 14, to be fitted into the feed holes 11, are provided in the rear end portions of the bottom walls 12 so as to project upwardly. Correspondingly, lock projections 15 for locking the lock holes 8 are provided in the front portions of the bottom walls 12, respectively. Finally, lock members 16 for preventing the contact piece fitting portions 7 from rising upwardly are provided in the front portions of the partition walls 13 respectively.

The procedure of attaching the solderless terminals 1 to the terminal holder 2 in the aforementioned configuration is as follows. As shown in FIGS. 1 through 3, after the solderless terminals 1 are fed to predetermined positions on the terminal holder 2 by means of the carrier 10 having the feed holes 11, the solderless terminals 1 are severed from the carrier 10 and mounted on the bottom walls 12 together with the portions of the feed holes 11 which remain with the terminals. Then, the fitting portions 14 are fitted into the feed holes 11 and, at the same time, the lock projections 15 are fitted into the lock holes 8, respectively.

When electric wires (not shown) are pressed down from above onto the electric-wire solderless contact portions 5, the coating portions of the electric wires are cut by the cutting edges which define slots 4 and the core of the electric wires come into contact with the cutting edges so as to be electrically connected to the solderless terminals 1. Finally, the electric wires are crimped by the electric wire crimping portions 9 so as to be fixed to the solderless terminals 1 respectively.

Because the feed holes 11 are provided in the rear end portions of the solderless terminals 1 the strength of the solderless terminals 1 is not reduced. Additionally, since the lock holes 8 are provided inside the contact piece fitting portions 7, the strength of the solderless terminals 1 is likewise not reduced.

Furthermore, since the fitting portions 14 and the lock projections 15 are provided so as to project from the bottom walls 12 of the terminal holder 2, the strength of the bottom walls 12 is not reduced. Accordingly, even if the electric wires are pulled in the rearward direction, the solderless terminals are prevented from being longitudinally displaced so that they will not become disengaged from the terminal holder 2.

Accordingly, there is no risk of short-circuiting accidents, or the like, caused by the displacement of the solderless terminals, so that the reliability of the connector can be further improved.

Furthermore, because the portions of feed holes 11 of the carrier 10 are utilized such that those portions remain in the rear end portions of the solderless terminals 1, portions of the carrier 10 which have been conventionally aborted are reduced. Consequently, productivity can be improved and material cost can be reduced.

It is of course understood that the present invention is not limited to the aforementioned embodiment. The invention can be applied also to crimp contact terminals or can be carried out in any other mode by making a suitable change or modification to the above embodiment.

Ledges 17 may be provided in the rear portion of the bottom walls 12 of the terminal holder 2 so as to abut against the rear end faces of the respective solderless terminals 1 as shown in FIG. 4. This assists in preventing longitudinal displacement of the solderless terminals 1 when the electric wires are pulled in the rearward direction. Consequently, the reliability of the solderless connector can be improved greatly.

Further, as shown in FIG. 5, the fitting portions 18 may be designed to include two portions separated by a gap 19 extending in the direction of the length of the solderless terminals 1. Each of the fitting portions 18 includes an upper guide slope 20 and a lock projection 21. The locking projections engage the rear portions of the solderless terminals 1 so that they do not become upwardly displaced from the terminal holder in the case where the substrate 3 is thin.

Accordingly, not only the manufacturability is improved but also the solderless terminals 1 can be surely prevented from moving longitudinally, so that the reliability of the solderless connector can be further improved.

What is claimed is:

1. A connector, comprising:

a terminal holder having a plurality of terminal accommodating chambers separated by partition walls, said terminal accommodating chambers being defined by said partition walls and bottom walls, said bottom walls each having a fitting portion projecting therefrom; and a plurality of terminals respectively provided in said terminal accommodating chambers, said terminals each including an opening in a bottom surface thereof which receives therein the respective fitting portion of said terminal holder to prevent said terminal from being withdrawn from said terminal accommodating chamber in a rearward direction of said terminal, wherein said plurality of terminals are initially secured to each other via a carrier strip, wherein a plurality of said openings function as feed holes for conveyance of said strip, and wherein said terminals are individually severed from said strip with said openings remaining in said terminals.

2. The connector of claim 1, wherein said terminal holder includes a locking projection for each of said terminal accommodating chambers and each of said terminals includes a locking hole in which each said locking projection is received.

3. The connector of claim 2, wherein each said terminal includes a contact portion at which a mating terminal contacts an associated one of said terminals.

4. The connector of claim 3, wherein said locking projection is provided in a base portion of each said terminal defining said contact portion.

5. The connector of claim 1, wherein said terminal holder includes a retaining member for each of said terminal accommodating chambers, said retaining member preventing said terminal from being moved in an upward direction, perpendicular to said rearward direction.

6. The connector of claim 1, wherein said terminal holder further includes a ledge provided at a rear portion of each of said terminal accommodating chambers, wherein a rear end of each of said terminals abuts against an associated one of said ledges to prevent said terminals from being moved in said rearward direction.

7. The connector of claim 1, wherein said fitting portion includes two flexible projections separated by a space, each of said projections including a retaining lip which engages an associated one of said terminals to retain said associated terminal within said terminal accommodating chamber.

8. The connector of claim 7, wherein each of said projections includes an uppermost inclined surface for inserting said projections through an associated one of said openings.

* * * * *